United States Patent [19]

Hisamura

[11] Patent Number: 4,766,048

[45] Date of Patent: Aug. 23, 1988

[54] ELECTROPHOTOGRAPHIC PHOTOSENSITIVE MEMBER HAVING SURFACE LAYER CONTAINING FINE SPHERICAL RESIN POWDER AND APPARATUS UTILIZING THE SAME

[75] Inventor: Masafumi Hisamura, Kawasaki, Japan

[73] Assignee: Canon Kabushiki Kaisha, Tokyo, Japan

[21] Appl. No.: 16,778

[22] Filed: Feb. 20, 1987

[30] Foreign Application Priority Data

Feb. 20, 1986 [JP] Japan ..... 61-33963

[51] Int. Cl.[4] ..... G03G 5/14

[52] U.S. Cl. ..... 430/58; 430/66; 430/67; 430/945; 430/950

[58] Field of Search ..... 430/58, 66, 67, 945, 430/950

[56] References Cited

U.S. PATENT DOCUMENTS 4,663,259 5/1987 Fujimura ..... 430/58

4,675,262 6/1987 Tanaka ..... 430/58

FOREIGN PATENT DOCUMENTS 86550 5/1985 Japan .

*Primary Examiner*—J. David Welsh

*Attorney, Agent, or Firm*—Fitzpatrick, Cella, Harper & Scinto

[57] ABSTRACT

An electrophotographic photosensitive member comprises an electroconductive support and a photosensitive layer laid thereon, the electrophotographic photosensitive member having a surface layer containing fine spherical resin powder.

35 Claims, 1 Drawing Sheet

ELECTROPHOTOGRAPHIC PHOTOSENSITIVE MEMBER HAVING SURFACE LAYER CONTAINING FINE SPHERICAL RESIN POWDER AND APPARATUS UTILIZING THE SAME

BACKGROUND OF THE INVENTION

1. Field of the Invention

This invention relates to a reusable electrophotographic photosensitive member, and more particularly to a reusable electrophotographic photosensitive member which was a coherent light as an incident light during image formation.

2. Description of Related Art

Electrophotographic photosensitive members utilizing inorganic photoconductive materials such as selenium, cadmium sulfide, zinc oxide, etc. as photosensitive components have been so far well known.

On the other hand, since it was found that specific organic compounds have a photoconductivity, so many organic photoconductive materials have been so far developed. Known are, for example, organic photoconductive polymers such as poly-N-vinylcarbazole, polyvinylanthracene, etc.; low molecular weight organic photoconductive materials such as carbazoles, anthracenes, pyrazolines, oxazoles, hydrazones, polyarylalkanes, etc.; and organic pigments or dyes such as phthalocyanine pigments, azo pigments, cyanine pigments, polycyclic quinone pigments, perylene-based pigments, indigo dyes, thioindigo dyes, squarilium dyes, etc.

Moreover photoconductive organic pigments or dyes can be more readily synthesized than the inorganic materials, and have a broader range of variations available for selecting compounds having a photoconductivity to an appropriate wavelength region, and so many photoconductive organic pigments and dyes have been so far proposed. Known are, for example, electrophotographic photosensitive members using a disazo pigment exhibiting a photoconductivity as a charge generating material in a photosensitive layer which is functionally separated into a charge generation layer and a charge transport layer, etc., as disclosed in U.S. Pat. Nos. 4,123,270; 4,247,614; 4,251,613; 4,251,614; 4,256,821; 4,260,672; 4,268,596; 4,278,747; and 4,293,628.

Generally, such electrophotographic photosensitive members as above have been developed mainly to obtain a higher sensitivity, less dependence upon environmental conditions, and constantly maintained characteristics. A reusable type, that is, an electrophotographic photosensitive member can be repeatedly used in the formation of images by removing the remaining developing agent therefrom after the formation of an image, has been so far used, owing to its simplicity, in the system for forming an image by means of the electrophotographic photosensitive member.

In the electrophotographic photosensitive member based on such a type, compatibility with a means for removing a developing agent is an important characteristic besides the other various characteristics of electrophotographic photosensitive member. If the compatibility with the means for removing the developing agent is poor, the surface of the photosensitive member will be damaged when the developing agent is fixed to or removed from the surface of the photosensitive member, restricting the repetition which may be run to a smaller number. Furthermore, the surface resistance will be lowered by deposition and tracking of materials of low resistance produced due to the surface deterioration of photosensitive member or due to the electrocharging process, resulting in the image unfocusing. To practically satisfy all of these requirements, so many attempts have been so far made, for example, by improvements of the developing agent, improvements of the means for removing the developing agent, improvements of processes to be used, improvements of physical properties of the photosensitive member, inclusion of a lubricant, etc.

However, these attempts are dependent entirely upon a combination of several kinds of techniques. Thus, it has been very difficult to obtain their effects at the same time or cost increase, etc. have been inevitable.

Particularly, an organic photosensitive member has weak mechanical strength and, when applied for a copying machine, a printer, etc., will suffer from formation of pinholes, minute cracks, abrasion at the end portions, peel-off, etc., to result in image defects.

For this reason, for increasing the mechanical strength of the organic photosensitive member, photosensitive members having particles dispersed in the photosensitive layer have been investigated. However, since particles cannot be dispersed uniformly, whereby pinholes, cracking, peel-off, etc. in photosensitive member are worsened to cause increased image defects.

In the image-forming process, selenium, selenium-based alloys, cadmium sulfide resin-distributed systems, charge transfer complexes of polyvinylcarbazole and trinitrofluorenone, etc. have been used as photosensitive materials for the electrophotographic printer using a coherent light, typified by laser, as a light source. As a laser, gas lasers such as helium-cadmium laser, argon laser, heliumneon laser, etc. have been used, and a semiconductor laser of small size and low cost, capable of direct modulation, has recently been available. However, most of the semiconductor lasers have an emitted light wavelength of 750 nm or more, and the photosensitive materials have a low photosensitivity in such a wavelength region, and have not been widely utilized. Under these circumstances, a lamination type photosensitive material composed of a charge generation layer and a charge transport layer has been regarded as an important photosensitive material for the semiconductor laser printer, because the photosensitive wavelength range can be relatively freely selected.

The charge generation layer of the lamination type photosensitive material plays a role of absorbing light to generate free charges, and to make the range of generated photocarriers shorter its thickness is usually as small as 0.1 to 5 μm. This is ascribable to absorption of most of the incident light in the charge generation layer, forming many photo carriers and the necessity for injecting the generated photo carriers into the charge transport layer without any deactivation due to recombination or trapping.

The charge transport layer plays a role of receiving static charges and transporting free charges without any substantial absorption of image-forming light, and its thickness is usually 5–30 μm. When images are produced by line scanning of a laser beam in a laser printer, using such a lamination type photosensitive material as above, line images such as letters, etc. have no problem, but black tone images have an uneven image density in an interference fringe state.

The cause for the development of the interference fringes seems to be that the charge generation layer is formed as a thin layer, as described above, and thus the quantity of light absorbed in the charge generation layer is so restricted that the light passed through the charge generation layer is reflected on the surface of the electroconductive support, causing the reflected light to undergo interfere with light reflected on the surface of the photoconductive layer.

The conventional lamination type electrophotoconductive photosensitive member comprises a charge generation layer 4 on an eleetroconductive support 3 laid on a support 2, and a charge transport layer 5 laid on the charge generation layer 4. When an incident layer beam 6, whose oscillation wavelength is about 780 nm in the case of a semiconductor laser and about 630 nm in the case of a helium-neon laser, is allowed to enter into the said lamination type electrophotographic photosensitive member, an interference develops between the incident light 7 to the charge transport layer and further to the inside of the photosensitive layer, and another reflected light 9 obtained by reflection of the incident light 7 on the electroconductive support 1 and emitted from the surface of the charge transport layer 5.

Let the refractive index of the lamination comprising the charge generation layer and the charge transport layer n, its thickness d, and the wavelength of laser beam $\lambda$. When nd is an integral multiple of $\lambda/2$, the intensity of the reflected light becomes a maximum, that is, the intensity of the light entering into the charge transport layer becomes a minimum according to the principle of the conservation of energy, whereas, when nd is an odd multiple of $\lambda/4$, the intensity of the reflected light becomes a minimum, that is, the intensity of the light entering into the charge transport layer becomes a maximum. However, the thickness d inevitably has an unevenness in the order of at least 0.2 $\mu$m inherent to the available production technique.

On the other hand, it is preferable that the laser beam is monochromatic, but the laser beam is coherent and thus the said interference conditions change in accordance with the unevenness in the thickness. That is, it seems that the quantity of a laser beam absorbed in the charge generation layer becomes locally uneven, causing to develop an uneven area image density in an interference fringe state.

In the ordinary electrophotographic copying machines, no monochromatic light is used as the light source, and thus the width of an interference fringes as a cause for the uneven density changes with the wavelength, and the uneven density disappears by the consequent balancing.

In the electrophotographic process using a laser beam, the development of uneven density in the interference fringe state has been so far prevented, for example, by roughening the reflecting surface of the support or the lamination interface for the electroconductive layer or the photosensitive layer, thereby providing an unevenness thereon to give a phase difference to the reflected light. However, in the case of the lamination type electrophotographic photosensitive member, a uniform photosensitive layer cannot be formed on such a uneven surface as obtained by the surface roughening, resulting in an image defect or considerable deterioration of photographic characteristics.

On the other hand, the method utilizing a photosensitive layer surface layer has been also investigated. That is, the techniques of effecting diffused reflection by such method as addition of coarse irregular shaped particles, irregular shaped fine particles with great agglomerating tendency, etc. have been known. However, none of them can control dispersion of the particles, to cause image defects as mentioned above.

Addition of coarse irregular shaped particles or irregular shaped particles with great agglomerating tendency, which may be techniques effective for diffused reflection, are susceptible to formation of irregular coarse defects on the photosensitive layer surface, thus giving rise to great problems such as black dots, fog, etc. on the image under the present situation.

Practically, although addition of coarse irregular shaped particles with an average particle size of 2 $\mu$m or more can cause diffused diffusion to occur effectively within the charge transport layer, such particles are generally liable to be sedimented and can maintain uniform state in a coating solution formulated by dispersion with difficulty and therefore it is difficult to produce them stably under the present situation.

On the other hand, fine particles with irregular shapes of 0.5 $\mu$ or less, have generally no effect of causing diffused reflection to occur within the charge transport layer, when dispersed uniformly in a binder solution. However, in the case of irregular shaped large particles with great agglomerating tendency or relatively poor affinity between the particles and the binder, it is possible to effect diffused reflection within the charge generation layer by agglomeration of fine particles. However, in this case, the degree of agglomeration can be controlled with extreme difficulty, whereby not only irregular and great defects are formed on the surface, but also agglomeration of fine particles occurs in the coating solution, and therefore it is very difficult to obtain production stability, as required for practical application.

As is obvious from the foregoing, an electrophotographic photosensitive member must have a specific sensitivity, electrical characteristics and optical characteristics applicable to an electrophotographic process. Particularly in the case of repeatedly usable electrophotographic photosensitive member, durability is further required against electrical and mechanical external forces such as corona charging, toner development, transfer to paper, cleaning treatment, etc. as applied directly to the surface layer of the electrophotographic photosensitive member. Specifically, durability is required against a decrease in the sensitivity or potential or an increase in the residual potential, caused by deteriorations due to the ozone generated during the corona charging, and also against attrition or damage on the surface due to the sliding friction.

On the other hand, the moisture resistance of the electrophotographic photosensitive member is also another important property. If the surface potential of an electrophotographic photosensitive member is considerably lowered at a high humidity, it is difficult to obtain a stably clear image, even though the electrophotographic photosensitive member has distinguished electrophotographic characteristics at a low humidity. Furthermore, in a transfer-type electrophotographic process, the electrophotographic photosensitive member is usually used repeatedly, and the moisture resistance is more liable to decrease owing to the electrocharging deterioration of the electrophotographic photosensitive member The decrease in the moisture resistance can be overcome to some degree by heating the electrophotographic photosensitive member, thereby drying it.

However, the heater must be always operated, resulting in a cost increase.

Furthermore, deposition of paper dust through contact with paper is a cause for smeared image at a high moisture, and residual toner due to the toner filming or poor cleaning considerably deteriorates the resulting image.

SUMMARY OF THE INVENTION

An object of the present invention is to provide an electrophotographic photosensitive member freed from the drawbacks of the prior art, that is, to provide an electrophotographic photosensitive member having a highly durable surface layer.

Another object of the present invention is to provide an electrophotographic photosensitive member for a laser printer, where the coherence is removed from an image-forming light by preventing development of uneven image density by the interference.

A further object of the present invention is to provide an electrophotographic photosensitive member without any development of a smeared or stained image by toner fusion at high temperature and humidity.

These objects of the present invention can be attained by an electrophotographic photosensitive member having a photosensitive layer on an electroconductive support, characterized in that a surface layer of the electrophotographic photosensitive member contains fine spherical resin powder.

DETAILED DESCRIPTION OF THE PREFERRED EMBODIMENT

Figure 1:
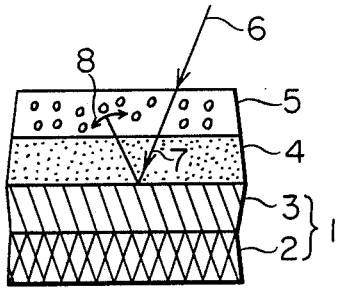
FIG. 1 is a schematic view showing a light path according to one embodiment of the present invention.
Figure 2:
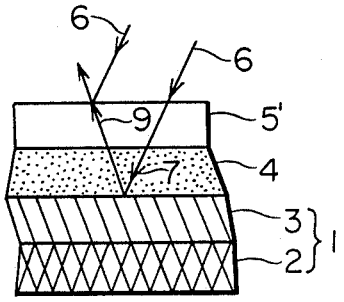
FIG. 2 is a schematic view showing an incident light path to the conventional electrophotographic member.

According to a preferable structure of the present electrophotographic photosensitive member, a photosensitive layer comprising a charge generation layer and a charge transport layer is laid on an electroconductive support. The electroconductive support is preferably in a lamination structure of a support and an electroconductive layer laid thereon, and the support is irrespective of the electroconductivity or non-electroconductivity. For example, the electroconductive support includes an aluminum cylinder, and an aluminum sheet, and the non-electroconductive support includes polymer films, polymer cylinders, composite materials of paper, plastics, or metals, etc.

The electroconductive layer is a resin layer containing electroconductive pigment powder and, if necessary, particles for forming surface irregularities, as dispersed therein, and any resin can be used for the resin layer, so long as it can satisfy the following conditions, that is, (1) a strong adhesion to the support, (2) a good powder dispersibility, and (3) a good solvent resistance. Particularly preferable resin is a thermosetting resin such as curable rubber, polyurethane, epoxy resin, alkyd resin, polyester, silicone resin, acryl-melamine resin, etc. The volume resistivity of the resin layer containing the electroconductivity powder as dispersed is $10^{13}$ Ω.cm or lower, preferably $10^{12}$ Ω.cm or lower. To this end, it is preferable that 10 to 60% by weight of the electroconductive powder is contained in the resin layer as applied on the basis of the total weight of the layer. The dispersion is carried out by an ordinary means such as roll mill, vibrating ball mill, attriter, sand mill, colloid mill, etc.

Application is carried out preferably by wire bar coating, blade coating, knife coating, roll coating, screen coating, etc. in the case of a sheet-form support, and by dip coating in the case of a cylindrical support.

In the present invention, an underlayer having a barrier function and also an adhesive function can be provided between the electroconductive layer and the photosensitive layer, if required.

The underlayer can be made from casein, polyvinyl alcohol, nitrocellulose, ethylene-acrylate copolymer, polyamides (Nylon 6, Nylon 66, Nylon 610, copolymerized Nylon, alkoxymethylated Nylon etc.), polyurethane, gelatin, aluminum oxide, etc. The underlayer has a film thickness of appropriately 0.1 to 5 μm, preferably 0.5 to 3 μm.

The charge generation layer can be formed by dispersing a charge-generating material such as azo pigments, for example, Sudan Red, Diane Blue, Janus Green B, etc.; quinone pigments, for example, Algol Yellow, Pyrenequinone, Indanthrene Brilliant Violet RRP, etc.; quinocyanine pigments; perylene pigments; indigo pigments, for example, indigo, thioindigo, etc.; bisbenzoimidazole pigments, for example, Indofast Orange toner, etc.; phthalocyanine pigments, for example, copper phthalocyanine, aluminum chloridephthalocyanine, etc.; quinacridone pigments, etc. into a binder resin such as polyester, polystyrene, polyvinylbutyral, polyvinylpyrrolidone, methylcellulose, polyacrylate esters, cellulose esters, etc. The charge generation layer has a film thickness of appropriately 0.01 to 1 μm, preferably 0.05 to 0.5 μm The charge transport layer can be formed by coating with a coating liquid containing a charge transporting material such as compound having in their main or side chain polycyclic aromatic compounds, for example, anthracene, pyrene, phenanthrene, coronene, etc., or nitrogen-containing cyclic compounds, for example, indole, carbazole, oxazole, isoxazole, thiazole, imidazole, pyrazole, oxadiazole, pyrazoline, thiadiazole, triazole, etc. or hydrazone compounds, etc. as dissolved or dispersed in a film-formable resin, followed by drying.

The film-formable resin includes, for example, acrylic resin, polyacrylate, polyester, polycarbonate, bisphenol A and Z type polystyrene, acrylonitrilestyrene copolymer, acrylonitrile-butadiene copolymer, polyvinylbutyral, polyvinylformal, polysulfone, polyacrylamide, polyamide, poly-N-vinylcarbazole, polyvinylanthracene, polyvinylpyrene, etc. The charge transport layer has a film thickness of appropriately 3 to 30 μm, preferably 5 to 20 μm.

For the spherical resin fine particles of the present invention, fine particles comprising a thermoplastic resin or a setting type resin are used.

Examples of the thermoplastic resin may include acrylic resin, styrene resin, polycarbonate resin, polyester resin, polyamide resin, etc.

As the acrylic resin, polymers of monomers such as methyl methacrylate, ethyl methacrylate, isopropyl methacrylate, phenyl mechacrylate, methyl acrylate, ethyl acrylate, etc. or copolymers of these monomers with other monofunctional monomers may be employed.

As the styrene resin, polymers of monomers such as styrene, methylstyrene, chlorostyrene and the like or copolymers of these monomers with other monofunctional monomers may be employed.

As the polycarbonate resin, polycondensates of bisphenol A and phosgene or polycondensates of bisphenol Z and phosgene, etc. may be employed.

As the polyester resin, polycondensates of dicarbozylic acid such as terephthalic acid, isophthalic acid, orthophthalic acid, etc. and ethylene glycol, propylene glycol, glycerine or copolycondensates thereof may be employed.

As the polyamide resin, polycondensates of ε-aminocaproic acid, ω-aminoundecanoic acid, etc., polycondensates of hexamethylenediamine and adipic acid, etc. may be employed.

As the setting type resin, for example, silicon resins, melamine resins, urea resins, acrylic resins, styrene resins may be employed.

As the silicone resin, thermal vulcanization type silicon rubbers, room temperature curable silicone rubbers, silicon resins, modified silicone resins, etc. may be employed.

As the melamine resin, condensates of melamine with cyanuric acid, polycondensates of melamine with formaldehyde, etc. may be employed.

As the urea resin, polycondensates of methylolurea, etc. may be employed.

As the acrylic resin, copolymers of monofunctional monomers such as methyl methacrylate, ethyl methacrylate, isopropyl methacrylate, phenyl methacrylate, methyl acrylate, ethyl acrylate and the like with polyfunctional monomers such as divinylbenzene, trivinylbenzene, etc. may be employed.

As the styrene resin, copolymers of monofunctional monomers such as styrene, methylstyrene, chlorostyrene and the like with polyfunctional monomers such as divinylbenzene, trivinylbenzene, etc. may be employed.

Of the spherical resin fine particles available in the present invention as mentioned above, particularly preferable spherical resin fine particles are spherical silicone resin fine particles.

The silicone resin generally has a poor compatibility with other resin, depending upon the inorganic characteristics of silicone group, and is hard and relatively brittle. The poor compativility with other resin means a distinguished effect upon prevention of a developing agent from anchoring, but single silicone resin has an insufficient durability due to damages or attrition owing to its brittleness.

It is well known in the material design to cause a microphase separation as so far seen in SBC rubber, thereby improving the damages and wearing resistance, and it is also possible to form a surface layer by blending with other resin, utilizing the incompatibility, but the surface layer cannot have a uniform film thickness owing to the microphase separation, and thus is not appropriate for an electrophotograhic photosensitive member.

In this respect, formation of a surface layer containing fine spherical silicone resin powder means a uniform formation of a surface layer, bring about the same state as that of microphase separation and thereby increasing the durability, and thus is a very appropriate means for obtaining an electrophotographic photosensitive member.

Furthermore, the incompatibility of silicone resin can be attained locally but completely owing to the microphase separation and thus the anchored toners can be released from a mold together with the silicone resin as their nuclei, and thus is effective for preventing the anchoring.

The characteristics of fine spherical silicone resin powder are (1) a good water repellent property, (2) a distinguished lubricating property, (3) a lower specific gravity than that of inorganic fine powder, (4) a better heat resistance than that of organic fine powder, (5) an insolubility in organic solvents, etc.

By mixing and dispersing fine spherical silicone resin powder into the photosensitive layer, preferably into the charge transport layer, the surface of the charge transport layer can be given a water repellent property and a lubricating property. Thus, distinguished environmental characteristics and wearing resistance can be obtained and the durability can be remarkably increased.

The spherical resin particles of the present invention are required as a premise to be insoluble in solvents. For example, when a ketone or ester type solvent is used, it is necessary to use polyamide or polyolefin type resin fine particles in combination.

If the spherical particle fine particles are of setting type resin, they are insoluble in solvents in most cases, whereby the above restriction can be avoided. In this respect, the spherical resin fine particles are preferably of a setting type resin.

The spherical resin fine particles of the present invention are contained in a photosensitive surface layer, preferably in a charge transport layer.

Irregular shaped particles are not dispersed uniformly to form projections, sinks, agglomeration, etc. in the surface layer, thereby causing partially image defects. Also, fine projections are formed wholly (which become white dots, black dots in the image) to lower image quality. Further, when irregular shaped particles are dispersed together with an organic binder in a solvent, agglomeration or precipitation of the coating liquid occurs, whereby no stable production can be performed disadvantageously.

Even in the case of spherical resin particles, if the average particle size is smaller than 1 μm, particularly 0.6 μm, the mechanical strength cannot be improved when dispersed in the surface layer. Also, agglomeration of fine particles occurs in the coated film to cause formation of image defects. On the other hand, if the average particle size is greater than 4 μm, particularly 6 μm, the aspect of the characteristics as the surface layer of the photosensitive member will be lowered.

Particularly, the average particle size of spherical silicon resin fine particles is preferably 8 μm or less, particularly 6 μm or less for the effect by microphase separation, while, if it is too small, the characteristics under mutually dissolved state are obtained to give no excellent effect of prevention of attachment and abrasion resistance of developer. Thus, an average particle size of 0.1 μm or more is preferred. On the other hand, resinous fine particles are more excellent in affinity for organic binders as compared with inorganic particles, being also relatively lighter in specific gravity, and therefore there are effects of further improving uniformity in dispersion, stability of the dispersion and uniformity of coated film. Accordingly, with a specific gravity of 0.7 to 1.7, preferably 0.9 to 1.5, the above effects can be greater. When the specific gravity is smaller than 0.7 or greater than 1.7, uniformity or stability of the dispersion cannot be obtained sufficiently in either case, whereby the coated film becomes nonuniform to cause lowering in image quality.

The spherical shape of the spherical resin fine particles in the present invention refers to one with a degree of sphericity of 0.5 or more, preferably 0.8 or more, as an average value in terms of the ratio of the diameter of the maximum incircle of the particle to the diameter of the minimum circumcircle of the particle as the circumcircle being 1, when at least 20 particles randomly selected are observed in a photograph by a scanning type electron microscope.

As a fine resin powder of the present invention, a spherical shape particle is employed. The shape is preferably round shape and ellipsoid shape, but a particle having irregular shape is not appropriate.

Measurement of the average particle size in the present invention is conducted by measuring the diameters of the respective particles by observation with a scanning type electron microscope and an average value of 20 points is taken. This operation is repeated three times, and further the average value is defined as the average particle size. However, in the case of a large distribution of particle sizes of the powder, it is necessary to make it uniform by shaking previously well.

Preferably 10 to 20% by weight of the fine spherical resin powder is contained in the surface layer, particularly the charge transport layer.

The fine silicone resin powder can be mixed in the following manner: the said charge-transporting material is dissolved into a film-forming resin, and then the fine spherical resin powder is mixed into the solution. Then, the mixture is subjected to through dispersion, for example, by a propeller stirrer or a sand mill.

When a laser beam is used as a light source for image exposure, and when the fine spherical resin powder is mixed and dispersed into the charge transport layer as shown in FIG. 1, the laser beam 7 reflected on the surface of the electroconductive support 1 is diffused in the charge transport layer 5 containing the fine spherical resin powder as laser beams 8 and is not interfered. Thus, any uneven image density due to the interference fringe is not observed on the image. Particularly when the particle size of the fine spherical resin powder is 1 to 4 μm (average particle size), good light scattering can be obtained, and thus a remarkable effect upon prevention of a coherent light from interference can be obtained.

When the particle size exceeds 6 μm, the charge transport property is deteriorated, and the sensitivity is lowered. Furthermore, an irregularity is liable to develop on the surface of the charge transport layer, causing an image defect.

When the particle size is less than 0.6 μm on the other hand, the diffusion effect of laser beam in the charge transport layer is lowered, and development of interference fringes cannot be prevented.

In the foregoing, the present invention has been described, referring to the lamination type photosensitive member, but even in the case of a single layer type photosensitive member, an electrophotographic photosensitive member having an equivalent effect thereto can be obtained by mixing fine spherical resin powder, particularly spherical silicone fine powder into the surface layer.

As described above, according to the electrophotographic photosensitive member of the present invention, there are the following advantages namely (1) improvement of mechanical strength of photosensitive member, (2) prevention of interference fringe of laser beam, (3) high sensitivity, high durability as photosensitive member, (4) obtaining of image of high quality with high resolving power also in image quality and without image defect, (5) coating liquid for charge transport layer excellent in liquid stability as different from the case of the prior art, thus resulting in stability of production and stability of characteristics, etc.

The present invention is described in detail by referring to the following Examples.

In the present invention, the mechanical strength of the charge transport layer was measured by means of a Taber tester.

As the testing method, an abrasion wheel around which a copying paper was wound was used and the data are represented as the value of amount of abrasion [$mm^3$] after the total rotational number of 5,000 at 60 rpm under a load of 500 g.

EXAMPLE 1

Two parts by weight of a copolymerized nylon resin (trade name: Amilan CM8000, produced by Toray) and 8 parts by weight of a copolymerized nylon resin (trade name: Toresin EF-30T, produced by Teikoku Kagaku) were dissolved in a mixture of 60 parts of methanol and 40 parts of butanol and applied by dipping on a 80ϕ×360 mm aluminum cylinder to provide a subbing layer with a thickness of 1 μm thereon.

Next, 10 parts of a disazo pigment having the following structural formula:

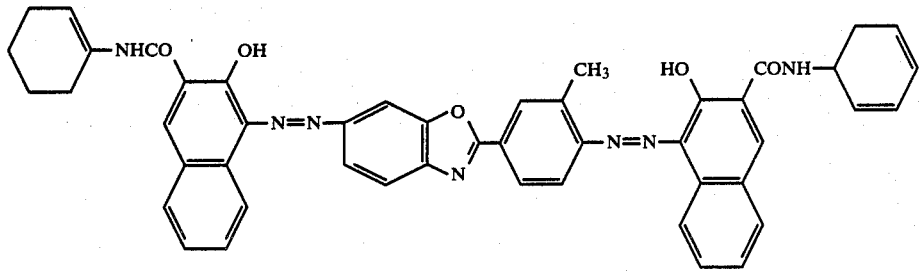

6 parts of a cellulose acetate butyrate resin (trade name: CAB-381, produced by Eastman Chemical) and 60 parts of cyclohexanone were dispersed by a sand mill device using glass beads for 20 hours. To the dispersion were added 100 parts of methyl ethyl ketone, and the resultant mixture was applied by dipping on the above subbing layer, followed by drying by heating at 100° C. for 10 minutes, to provide a charge generation layer with a coated amount of 0.1 $g/m^2$.

Next, 10 parts of a hydrazone compound having the following structure:

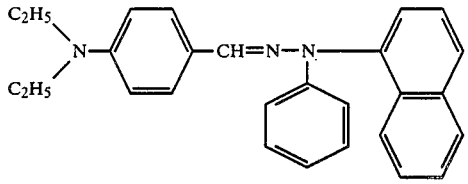

and 15 parts of a polymethylmethacrylate resin (trade name: BR-50, produced by Mitsubishi Rayon) were dissolved in 80 parts of dichloromethane.

To the solution were added 2 parts of spherical silicon resin fine particles (polymethylsilisesquioxane, specific gravity 1.3, average particle size 1.2 μm), and the mixture was dispersed by a sand mill over 2 hours. The dispersion was applied on the above charge generation layer, followed by drying in hot air at 100° C. for one hour, to form a charge transport layer having a thickness of 20 μm, thus providing a photosensitive member No. 1.

Also, a charge transport layer was prepared on a Mylar sheet and Taber test was conducted.

The photosensitive member No. 1 was mounted on a copying machine (NP-3525, produced by Canon) to effect image formation. The image qualities and amounts of the photosensitive member abraded at the initial stage and after successive copying for 50,000 sheets are shown in Table 1.

Also, the dark potentials and exposure potentials of this photosensitive member were measured at the initial stage and after successive copying for 50,000 sheets, and stability of potential is shown in Table 1. The exposure dose is 3 lux.sec.

COMPARATIVE EXAMPLE 1

An electrophotographic photosensitive member No. 3 was prepared according to entirely the same method as in 1 except for omitting the spherical silicon resin fine particles in the charge transport layer in Example 1.

Evaluation of the photosensitive member was conducted similarly as in Example 1 and the results are shown in Table 1.

COMPARATIVE EXAMPLE 2

An electrophotographic photosensitive member No. 4 was prepared according to entirely the same method as in Example 1 except for changing the average particle size of the spherical silicone resin fine particles in the charge transport layer in Example 1 to 0.4 μm.

Evaluation of the photosensitive member was conducted similarly as in Example 1 and the results are shown in Table 1.

COMPARATIVE EXAMPLE 3

An electrophotographic photosensitive member No. 5 was prepared according to entirely the same method as in Example 1 except for changing the average particle size of the spherical silicone resin fine particles in the charge transport layer in Example 1 to 10 μm.

Evaluation of the photosensitive member was conducted similarly as in Example 1 and the results are shown in Table 1.

COMPARATIVE EXAMPLE 4

An electrophotographic photosensitive member No. 6 was prepared according to entirely the same method as in Example 1 except for using zinc oxide fine particles (zinc oxide, specific gravity 5.6, irregular needle crystal, average particle size 3.8 μm) in place of the spherical silicone resin fine particles in the charge transport layer in Example 1.

Evaluation of the photosensitive member was conducted similarly as in Example 1 and the results are shown in Table 1.

EXAMPLE 2

An electrophotographic photosensitive member No. 2 was prepared according to entirely the same method as in Example 1 except for changing the average particle size of the spherical silicone resin fine particles in the charge transport layer in Example 1 to 3.6 μm.

Evaluation of the photosensitive member was conducted similarly as in Example 1 and the results are shown in Table 1.

TABLE 1

| | Example 1 | Example 2 | Comparative example 1 | Comparative example 2 | Comparative example 3 | Comparative example 4 |
|---|---|---|---|---|---|---|
| Photosensitive member No. | No. 1 | No. 2 | No. 3 | No. 4 | No. 5 | No. 6 |
| Spherical fine particles | Silicone resin | Silicon resin | None | Silicone resin | Silicone resin | Zinc oxide (non-spherical) |
| Average particle size | 1.2 μm | 3.6 μm | — | 0.4 μm | 7 μm | 3.8 μm |
| Taber abraded amount [$mm^3$] | 0.9 | 0.8 | 12.0 | 15.0 | 10.0 | 10.5 |
| Coated film surface | Uniform | Uniform | Uniform | Uniform | Great roughness Coating irregularity | Great roughness |
| Initial image quality | High resolving power No black dot or white dot No fog | High resolving power No black dot or white dot No fog | High resolving power No black dot or white dot No fog | Slightly low resolving power | Low resolving power Many white dots | Low resolving power Many white dots |
| Image quality after 50,000 sheets successive copying | No abnormality | No abnormality | Density lowered White streak generated | Density lowered | Density lowered White dots increased | Density lowered White dots increased |
| Abraded film thickness after 50,000 sheets | 1.0 μm | 0.8 μm | 8.0 μm | 10.0 μm | 7.0 μm (Pinhole generated) | 12.2 μm (Pinhole generated) |
| Initial dark potential | −700 V | −690 V | −700 V | −690 V | −720 V | −650 V |
| Exposure potential | −190 V | −200 V | −190 V | −190 V | −195 V | −170 V |

TABLE 1-continued

| | Example 1 | Example 2 | Comparative example 1 | Comparative example 2 | Comparative example 3 | Comparative example 4 |
|---|---|---|---|---|---|---|
| Dark potential after 50,000 sheets successive copying | −680 V | −670 V | −450 V | −400 V | −480 V | −390 V |
| Exposure potential | −230 V | −220 V | −140 V | −100 V | −150 V | −110 V |
| Stability of coating liquid for charge transport layer | No problem for one month | No problem for one month | No problem for one month | Agglomeration of particles generated with 2 weeks | No problem for one month | Particles precipitated within 1 day, liquid conc. became non-uniform |
| Degree of sphericity (incircle diameter/circumcircle diameter) | 0.80 | 0.92 | — | 0.60 | 0.97 | 0.3 |

As the result of this experiment, it has been found that the electrophotographic photosensitive member having a charge transport layer formulated with spherical resin fine particles with an average particle size of 1.2 μm or 3.6 μm has high image quality without image defects (e.g. white dots, black dots, fog, etc.) as well as excellent durability with strong mechanical strength according to Taber abrasion test, and also has excellent production stability without formation of agglomeration, precipitation, etc. of the coating liquid.

On the other hand, as shown in Comparative example 4, when zinc oxide particles of inorganic particles are used, since inorganic particles are non-spherical in most cases to be insufficient in affinity (dispersibility) for a binder solution and yet non-shperical shapes make the coated surface unevenly rough, the problems such as low resolving power in image quality, presence of white dots, fog, etc. were recognized. Further, the coating liquid gave rise to precipitation of particles within one day, thus indicating extremely bad production stability.

Even in the case of spherical resin particles, if the average particle size is 0.4 μm, the coating liquid is poorly stable, with agglomeration occurring within 2 to 3 weeks and, in successive copying test, white dots and black dots were formed. Further, although not shown in the Table, in the case of the average particle size of 0.3 μm, agglomeration occurred in the coating liquid within one week.

On the other hand, in the case of the average particle size of 7 μm, difficulties were encountered from the initial stage in resolving power, image defect (white dot) and, the image defects (white dots, black dots) became increased in the successive copying test for 50,000 sheets, with generation of pinhole being also recognized.

EXAMPLE 3

Ten parts of a polyester resin (trade name: Byron 200, produced by Toyobo) were dissolved in 200 parts of methyl ethyl ketone, and the solution was applied on an aluminum cylinder to provide an intermediate layer with a thickness of 0.3 μm.

Next, a charge generation layer was formed in the same manner as in Example 1 except for adding 6 parts of a butyral resin (trade name: S.LEC BL-S, produced by Sekisui Kagaku) in place of the celulose acetate butyrate resin in the charge generation layer in Example 1.

A charge transport layer was obtained by adding spherical melamine resin fine particles (melamine-formaldehyde polycondensate, specific gravity 1.4, average particle size 3.0 μm) in place of the spherical silicone resin fine particles in the charge transport layer in Example 1 to prepare an electrophotographic photosensitive member No. 7.

Evaluation of the photosensitive member was conducted similarly as in Example 1 to obtain the results shown in Table 2.

EXAMPLE 4

Example 3 was repeated except that a charge transport layer was formed by adding spherical styrene resin fine particles (polystyrene-divinylbenzene copolymer resin, specific gravity 1.0, average particle size 1.2 μm) in place of the spherical melamine resin fine particles in the charge transport layer in Example 3, to obtain an electrophotographic photosensitive member No. 8.

Evaluation of the photosensitive member was conducted similarly as in Example 1 to obtain the results shown in Table 2.

COMPARATIVE EXAMPLE 5

Example 3 was repeated except that the spherical melamine resin fine particles were omitted in the charge transport layer in Example 3, to prepare an electrophotographic photosensitive member No. 9.

Evaluation of the photosensitive member was conducted similarly as in Example 1 to obtain the results shown in Table 2.

TABLE 2

| | Example 3 | Example 4 | Comparative example 5 |
|---|---|---|---|
| Photosensitive member No. | No. 7 | No. 8 | No. 9 |
| Spherical fine particles | Melamine resin | Styrene resin | None |
| Average particle size | 3.0 μm | 1.2 μm | — |
| Taber abraded amount [mm$^3$] | 1.5 | 1.3 | 11.0 |
| Coated film surface | Uniform | Uniform | Uniform |
| Initial image | High resolving power No black dot or | High resolving power No black dot or | High resolving power No black dot or |

TABLE 2-continued

| | Example 3 | Example 4 | Comparative example 5 |
|---|---|---|---|
| quality | white dot No fog | white dot No fog | white dot No fog |
| Image quality after 50,000 sheets successive copying | No abnormality | No abnormality | Density lowered White streak generated |
| Abraded film thickness after 50,000 sheets | 1.9 μm | 1.8 μm | 11.0 μm |
| Initial dark potential | −710 V | −700 V | −690 V |
| Exposure potential | −210 V | −220 V | −210 V |
| Dark potential after 50,000 sheets successive copying | −690 V | −720 V | −380 V |
| Exposure potential | −240 V | −270 V | −180 V |
| Stability of coating liquid for charge transport layer | No problem for one month | No problem for one month | No problem for one month |
| Degree of sphericity (incircle diameter/ circumcircle diameter) | 0.70 | 0.65 | — |

EXAMPLE 5

100 Parts by weight of electroconductive titanium oxide powder (a product made by Titan K.K., Japan), 100 parts by weight of titanium oxide powder (product made by Sakai Kogyo K.K., Japan), and 125 parts by weight of phenol resin (Plyophen, trade mark of a product made by Dai-Nippon Ink K.K., Japan) were mixed into a solvent mixture comprising 50 parts by weight of methanol and 50 parts by weight of methylcellosolve, and then the mixture was dispersed in a ball mill for 6 hours.

The thus obtained dispersion was applied to an aluminum cylinder, 60 mm in diameter (ϕ)×260 mm long, by a dipping method, and thermoset at 150° C. for 30 minutes, whereby an electroconductive layer having a film thickness of 20 μm and a surface roughness of 1.5 μm was obtained.

Then, 10 parts by weight of copolymerized nylon resin (amilan CM8000, trademark of a product made by Toray K.K., Japan) was dissolved in a liquid mixture comprising 60 parts by weight of methanol and 40 parts by weight of butanol, and the thus obtained solution was applied to the said electroconductive layer by dipping, whereby a polyamide layer having a film thickness of 1 μm was obtained.

Then, 100 parts by weight of E type copper phthalocyanine (a product made by Toyo Ink K.K., Japan), 50 parts by weight of butyral resin (a product made by Sekisui Kagaku K.K., Japan) and 1,350 parts by weight of cyclohexane were dispersed in a sand mill using glass beads, 1 mm (ϕ) in diameter, for 20 hours. The thus obtained dispersion was admixed with 2,700 parts by weight of methylethylketone, and the thus obtained mixture was applied to the said polyamide layer by dipping, and heated and dried at 50° C. for 10 minutes, whereby a charge generation layer having an areal ight of 0.15 g/m$^2$ was obtained.

Then, 10 parts by weight of the hydrazone compound having the following structural formula and 15 parts by weight of styrenemethyl methacrylate copolymer resin (MS200, trademark of a product made by Seitetsu Kagaku K.K., Japan) were dissolved in 80 parts by weight of toluene.

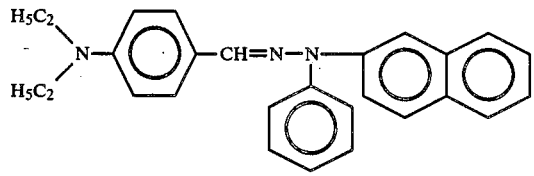

The thus obtained solution was admixed with 5 parts by weight of fine spherical silicone resin powder (XC99-501, trademark of a product made by Toshiba Silicone K.K., Japan: average particle size: 2 μm), and then the mixture was dispersed in a sand mill for one hour.

The thus obtained dispersion was applied to the said charge generation layer, and dried in hot air at 100° C. for one hour, whereby a charge transport layer having a film thickness of 16 μm was obtained.

To test image printing, the thus prepared lamination-type photosensitive drum No. 10 was mounted on a laser printer tester with a gallium-aluminum-arsenic semiconductor laser (emitted light wavelength: 780 nm, power: 5 mW), provided with a corona charger (charging: negative pole type), a developing device, a transfer charger, and a cleaner. It was found that the black tone image had even image density and the line image was sharp.

The same photosensitive drum as above was subjected to a continuous image printing durability test under such two environmental conditions as the temperature of 23° C. and the humidity of 60%, and the temperature of 35° C. and the humidity of 80% to continuously print 5,000 copies of paper sheets (A4 type). It was found that neither smeared image nor contaminated image due to the toner fusion was developed under the said two enviromental conditions, and the same good images as those in the initial period could be obtained.

Further, the image quality after 50,000 sheets successive copying under such environmental conditions as temperature of 23° C. and humidity of 60% and the abrasion amount of the photosensitive member at that time were shown in Table 3. Additionally, the dark place potential and exposure potential of the photosensitive member was measured at the initial stage and after 50,000 sheets successive copying, and the potential stability was shown in the table. The exposure quantity was 9 lux.sec. Next, a charge transport layer was formed on the Mylar sheet to conduct the Taber test.

COMPARATIVE EXAMPLE 6

An electroconductive layer, an underlayer and a charge generation layer were successively formed by coating on an aluminum cylinder quite in the same manner as in Example 5, and then a charge transport layer containing no fine silicone resin powder was further formed thereon by coating to form a photosensitive drum No. 11 for comparison.

Then, the photosensitive drum for comparison was mounted on the same laser printer tester as used in Example 1 and subjected to image printing. It was found that the line images had no problem, but the black tone image had an uneven image density due to the interference.

In spite of the occurrence of the uneven image density, the drum was subjected to a continuous image-printing durability test in the same manner as in Example 5, and it was found that the sensitivity was lowered owing to the scraping of the charge transport layer when 5,000 copies of paper sheets (A4 type) were printed, and consequently the image density was lowered.

The photosensitive member was evaluated in the same manner as Example 5, and the results were shown in Table 3.

EXAMPLE 6

An electroconductive layer, an underlayer and a charge generation layer were successively formed by coating on an aluminum cylinder in the same manner as in Example 5.

Then, 3 parts by weight of fine silicone resin powder (XC99-301, trade mark of a product made by Toshiba Silicone K.K., Japan: average particle size: 4 μm) was added to the same charge-transporting material composition as used in Example 5, and dispersed in the same manner as in Example 5. The thus obtained dispersion was applied to the charge generation layer to form a charge transport layer. Thus, an electrophotographic photosensitive member was obtained.

The thus obtained drum No. 12 was subjected to an image printing test in the same manner as in Example 5, and it was found that the black tone image had an even image density and the line image was a little poorer than that of Example 1, but still sharp.

The photosensitive drum was further subjected to a continuous image printing durability test under the same environmental conditions as in Example 5 to continuously print 5,000 copies of paper sheets (A4 type). It was found in the same as in Example 5 that neither smeared image nor contaminated image due to the toner fusion was developed, and the same good images as those in the initial period could be obtained.

The photosensitive member was evaluated in the same manner as Example 5, and the results were shown in Table 3.

COMPARATIVE EXAMPLE 7

An electroconductive layer, an underlayer, and a charge generation layer were formed by coating on an aluminum cylinder quite in the same manner as in Example 5.

4 parts by weight of zinc oxide powder was added to the same charge-transporting material composition as in Example 5 and dispersed in the same manner as in Example 1, and the thus obtained suspension was applied to the charge generation layer to form a charge transport layer. Thus, a photosensitive drum No. 13 for comparison was obtained.

The photosensitive drum for comparison was subjected to an image printing test in the same manner as in Example 5, and it was found that the black tcne image had no uneven image density due to the interference, but the sensitivity was lowered and the image became light, because the charge was trapped by the zinc oxide contained in the charge transport layer.

The photosensitive member was eveluated in the same manner as Example 5, and the results were shown in Table 3.

TABLE 3

| | Example 5 | Comparative example 6 | Example 6 | Comparative example 7 |
|---|---|---|---|---|
| Photosensitive member No. | No. 10 | No. 11 | No. 12 | No. 13 |
| Spherical fine particles | Silicone resin | None | Silicone resin | Zinc oxide |
| Average particle size | 2μ | — | 4μ | 4μ |
| Taber abraded amount [mm$^3$] | 2.0 | 15.0 | 2.3 | 10.7 |
| Coated film surface | Uniform | Uniform | Uniform | Great roughness |
| Initial image quality | High resolving power No black dot or white dot No fog No interference fringe | No black dot and white dot No fog Interference fringe present | High resolving power No black dot or white dot No fog No interference fringe | Many black dots White dots present |
| Image quality after 50,000 sheets successive copying | No abnormality | Black streak generated | No abnormality | Black streak generated Fog generated |
| Abraded film thickness after 50,000 sheets | 4.0 μm | 14.0 μm | 5.0 μm | 9.8 μm |
| Initial dark potential | −710 V | −690 V | −720 V | −685 V |
| Exposure potential | −150 V | −140 V | −140 V | −190 V |
| Dark potential after 50,000 sheets successive copying | −650 V | −90 V | −660 V | −200 V |
| Exposure potential | −180 V | −10 V | −190 V | −40 V |
| Stability of coating liquid for charge | No problem for one month | No problem for one month | No problem for one month | Particles precipitated within 1 |

TABLE 3-continued

| | Example 5 | Comparative example 6 | Example 6 | Comparative example 7 |
|---|---|---|---|---|
| transport layer | | | | day, liquid conc. became nonuniform |
| Degree of sphericity (incircle diameter/ circumcircle diameter) | 0.88 | — | 0.92 | 0.31 |

EXAMPLE 7

100 parts by weight of electroconductive titanium oxide powder (produced by Titanium Kogyo), 100 parts by weight of titanium oxide powder (produced by Sakai Kogyo), 125 parts by weight of a phenol resin (produced by Dainippon Ink Co., Plyophen) and 0.02 part by weight of a silicone type surfactant (Toray Silicone) were dissolved in 50 parts by weight of methanol and 50 parts by weight of methyl cellosolve, and the mixture was then dispersed by a ball mill for 6 hours. The dispersion was applied on an aluminum cylinder of 60ϕ×260 mm by the dipping method, thermally cured at 150° C. for 30 minutes to provide an electroconductive layer with a film thickness of 20μ.

Next, 2 parts (by weight, hereinafter the same) of a copolymerized nylon resin (trade name: Amilan CM 8000, produced by Toray) and 8 parts of a copolymerized nylon resin (trade name: Toresin EF-30T, produced by Teikoku Kagaku) were dissolved in a mixture of 60 parts of methanol and 40 parts of butanol, and the solution was applied onto the above electroconductive layer by dipping to provide a subbing layer with a thickness of 1μ.

Next, 10 parts of a disazo pigment having the following formula:

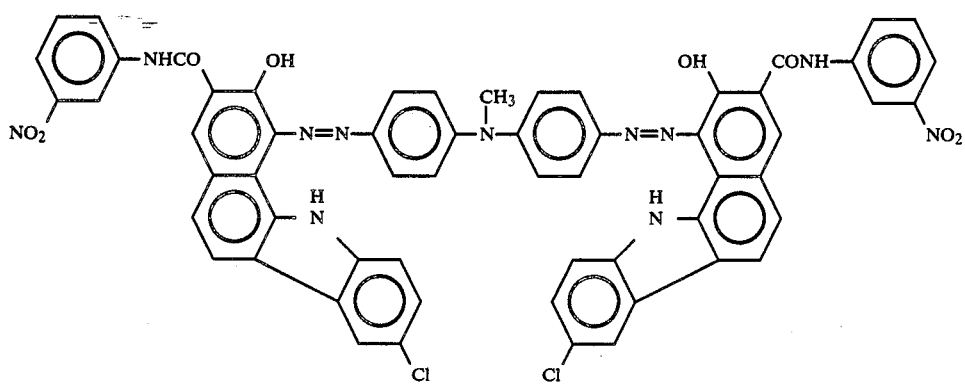

6 parts of an acrylic resin (Dianal BR-80, produced by Mitsubishi Rayon) and 60 parts of cyclohexanone were dispersed by a sandmill device by use of 1 ϕ glass beads for 20 hours. To the dispersion were added 2700 parts by weight of methyl ethyl ketone, and the diluted dispersion was applied by dipping on the above polyamide resin layer, followed by drying by heating at 50° C. for 10 minutes, to provide a charge generation layer with a coated amount of 0.15 g/m².

Next, 10 parts of a hydrazone compound of the following formula:

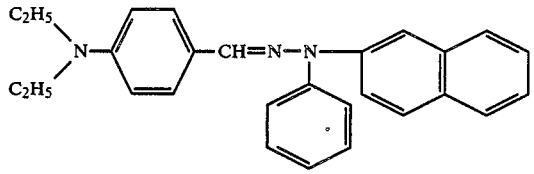

and 15 parts of a polycarbonate resin (trade name: Panlite L-1250, produced by Teijin Kasei K.K.) were dissolved in 80 parts of dichloromethane.

To the resultant solution were added 2 parts of spherical silicone resin fine particles (polymethylsilsesquioxane, specific gravity 1.3, average particle size 1.8 μm), and dispersed therein by a sand mill over 2 hours. The dispersion was applied on the above charge generation layer, followed by drying in hot air at 100° C. for one hour, to form a charge transport layer with a thickness of 20 μm, thus providing an electrophotographic photosensitive member No. 14.

Also, on a Mylar sheet, the charge transport layer was similarly prepared and subjected to the Taber test.

The photosensitive member No. 14 was mounted on a laser printer (LPB-8: produced by Canon) to perform image formation. Image qualities at the initial stage and after successive copying of 50,000 sheets are shown in Table 4.

In the initial image, no interference fringe inherent in LBP is not recognized, to give good results with good resolving power and substantially no image defects.

Further, also in succesive copying test of 50,000 sheets, no abnormality was recognized.

Also, the dark potential and the exposure potential were measured at the initial stage and after successive copying of 50,000 sheets, and the stability of potential is shown in Table 4. The exposure dose was 3 μJ/cm².

EXAMPLE 8

An electrophotographic photosensitive member No. 15 was prepared according to entirely the same method as in Example 7 except that the average particle size of the spherical silicone resin fine particles in the charge transport layer in Example 7 was changed to 4.0 μm.

The photosensitive member was evaluated similarly as in Example 7 and the results are shown in Table 4.

COMPARATIVE EXAMPLE 8

An electrophotographic photosensitive member No. 16 was prepared according to entirely the same method as in Example 7 except that the spherical silicone resin fine particles in the charge transport layer in Example 7 were omitted.

The photosensitive member was also evaluated in the same manner as in Example 7 to obtain the results shown in Table 4.

In the initial image, interference fringe due to interference by laser beam was generated, whereby uniformity of image was markedly inferior. In the successive copying test, image defects occurred based on cracking and peel-off of the photosensitive layer.

COMPARATIVE EXAMPLE 9

An electrophotographic photosensitive member No. 17 was prepared according to entirely the same method as in Example 7 except that the average particle size of the spherical silicone resin fine particles in the charge transport layer in Example 7 was changed to 0.4 μm.

The photosensitive member was evaluated silimarly as in Example 7 and the results are shown in Table 4.

COMPARATIVE EXAMPLE 10

An electrophotographic photosensitive member No. 18 was prepared according to entirely the same method as in Example 7 except that the average particle size of the spherical silicone resin fine particles in the charge transport layer in Example 7 was changed to 8.0 μm.

The photosensitive member was evaluated similarly as in Example 7 and the results are shown in Table 4.

COMPARATIVE EXAMPLE 11

An electrophotograhic photosensitive member No. 19 was prepared according to entirely the same method as in Example 7 except that zinc oxide fine particles (zinc oxide, specific gravity 5.6, average particle size 4.0 μm) were used in place of the spherical silicone resin fine particles in the charge transport layer in Example 7.

The photosensitive member was evaluated similarly as in Example 7 and the results are shown in Table 4.

TABLE 4

| | Example 7 | Example 8 | Comparative example 8 | Comparative example 9 | Comparative example 10 | Comparative example 11 |
|---|---|---|---|---|---|---|
| Photosensitive member No. | No. 14 | No. 15 | No. 16 | No. 17 | No. 18 | No. 19 |
| Spherical fine particles | Silicone resin | Silicone resin | None | Silicone resin | Silicone resin | Zinc oxide (non-spherical) |
| Average particle size | 1.8 μm | 4.0 μm | — | 0.4 μm | 8.0 μm | 4.0 μm |
| Taber abraded amount [$mm^3$] | 1.1 | 0.9 | 10.1 | 8.2 | 7.1 | 12.0 |
| Coated film surface | Uniform | Uniform | Uniform | Uniform | Many white dots generated | Great roughness |
| Initial image quality | High resolving power No black dot or white dot No fog No interference fringe | High resolving power No black dot or white dot No fog No interference fringe | No black dot or white dot Interference fringe present | No black dot or white dot Interference fringe present | Low resolving power Many black dots | Low resolving power Many black dots Fog present |
| Image quality after 50,000 sheets successive copying | No abnormality | No abnormality | Black dots increased Fog generated | Black dots increased Fog generated | Black dots, white dots increased Fog generated | Black dots, white dots increased Fog worsened |
| Abraded film thickness after 50,000 sheets | 1.5 μm | 0.9 μm | 10.2 μm | 9.7 μm | 9.2 μm (Pinhole generated) | 15.1 μm (Pinhole generated) |
| Initial dark potential | −700 V | −690 V | −685 V | −710 V | −725 V | −690 V |
| Exposure potential | −100 V | −110 V | −120 V | −115 V | −130 V | −160 V |
| Dark potential after 50,000 sheets successive copying | −750 V | −740 V | −400 V | −420 V | −380 V | −300 V |
| Exposure potential | −200 V | −190 V | −140 V | −150 V | −100 V | −80 V |
| Stability of coating liquid for charge transport layer | No problem for one month | No problem for one month | No problem for one month | Agglomeration of particles generated within 2 weeks | No problem for one month | Agglomeration of particles generated within 1 day |
| Degree of sphericity (incircle diameter/circumcircle diameter) | 0.82 | 0.89 | — | 0.68 | 0.88 | 0.23 |

EXAMPLE 9

100 parts by weight of an electroconductive carbon paint (Dotite produced by Fujikura Kasei), 50 parts of a melamine resin (Superpetsgun produced by Dainippon Ink) and 5 parts by weight of aluminum oxide powder (average particle size 5 μm) were mixed in 100 parts by weight of toluene, and subsequently dispersed by a ball mill over 6 hours. The dispersion was applied by a dipping method on an aluminum cylinder and thermally cured at 150° C. for 30 minutes to provide an electroconductive layer with a film thickness of 20 μm.

Next, as the polyurethane resin, 5 parts of Nipporane 800 (produced by Nippon Polyurethane K.K.) and 5 parts of Coronate 2507 (produced by Nippon Polyurethane K.K.) together with 0.01 part of a curing agent (dibutyltin laurate) were dissolved in 150 parts of methyl ethyl ketone, and the above subcoating was coated by dipping with the resultant solution and dried by heat at 150° C. for 30 minutes to obtain a subbing layer.

Next, in the charge generation layer in Example 7, 6 parts of a cellulose acetate butyrate resin (trade name: CAB 381, produced by Eastman Chemical) were added in place of the polyester resin to form a charge generation layer.

Next, in the charge transport layer in Example 7, spherical melamine resin fine particles (melamineisocyanurate copolycondensate, specific gravity 1.5, average particle size 4 μm) were added in place of the spherical silicone resin fine particles, and following otherwise the same procedure as in Example 7, an electrophotographic photosensitive member No. 20 was prepared. The photosensitive member was evaluated similarly as in Example 7 to obtain the results shown in Table 5.

resin fine particles in the charge transport layer in Example 9.

The photosensitive member was evaluated similarly as in Example 7 to obtain the results shown in Table 5.

COMPARATIVE EXAMPLE 13

An electrophotographic photosensitive member No. 23 was obtained according to the same procedure as in Example 9 except for using particles of a polyethylene with particle sizes of 20 to 30 μm which were pulverizes by a colloid mill into an average particle size of 5.5 μm as the irregular shaped resin particles in place of the spherical melamine resin fine particles in the charge transport layer in Example 9.

The photosensitive member was evaluated similarly as in Example 7 to obtain the results shown in Table 5.

TABLE 5

| | Example 9 | Example 10 | Comparative example 12 | Comparative example 13 |
|---|---|---|---|---|
| Photosensitive member No. | No. 20 | No. 21 | No. 22 | No. 23 |
| Spherical fine particles | Melamine resin | Acrylic resin | None | Polyethylene (non-spherical) |
| Average particle size | 4.0 μm | 1.5 μm | — | 5.5 μm |
| Taber abraded amount [$mm^3$] | 1.5 | 2.2 | 9.0 | 3.0 |
| Coated film surface | Uniform | Uniform | Uniform | Great roughness |
| Initial image quality | High resolving power No black dot or white dot No fog No interference fringe | High resolving power No black dot or white dot No fog No interference fringe | No black dot or white dot No fog Interference fringe present | Many black dots White dots present No interference fringe |
| Image quality after 50,000 sheets successive copying | No abnormality | No abnormality | Black streak generated Fog generated | Black dots increased |
| Abraded film thickness after 50,000 sheets | 2.0 μm | 2.5 μm | 15.0 μm | 5.0 μm (Pinhole generated) |
| Initial dark potential | −690 V | −670 V | −700 V | −710 V |
| Exposure potential | −130 V | −140 V | −120 V | −190 V |
| Dark potential after 50,000 sheets successive copying | −720 V | −710 V | −300 V | −600 V |
| Exposure potential | −210 V | −250 V | −90 V | −210 V |
| Stability of coating liquid for charge transport layer | No problem for one month | No problem for one month | No problem for one month | Particles agglomerated within 10 hours |
| Degree of sphericity (incircle diameter/circumcircle diameter) | 0.82 | 0.74 | — | 0.33 |

EXAMPLE 10

Example 9 was repeated except that the charge transport layer was formed by adding spherical acrylic resin fine particles (polymathyl methacrylatedivinylbenzene copolymer resin, specific gravity 1.1, average particle size 1.5 μm) in place of the spherical melamine resin fine particles in the charge transport layer in Example 9 to obtain an electrophotographic photosensitive member No. 21.

The photosensitive member was evaluated similarly as in Example 7 to obtain the results shown in Table 5.

COMPARATIVE EXAMPLE 12

An electrophotographic photosensitive member No. 22 was obtained according to the same procedure as in Example 9 except for adding no spherical melamine

I claim:

1. An electrophotographic photosensitive member which comprises an electroconductive support having a photosensitive layer thereon, wherein the electrophotographic photosensitive member has a surface layer containing fine spherical resin powder having an average degree of sphericity of at least 0.5 in terms of the ratio of the diameter of the maximum incircle of the particles to the diameter of the minimum circumcircle of the particles as the circumcircle being 1, when at least 20 randomly selected particles are observed by a scanning electron microscope.

2. An electrophotographic photosensitive member according to claim 1, wherein said fine spherical resin particles are of a setting type resin.

3. An electrophotographic photosensitive member according to claim 2, wherein said setting the resin is a resin selected from silicon resins, melamine resins, urea resins, acrylic resins and styrene resins.

4. An electrophotographic photosensitive member according to claim 1, wherein said fine spherical resin particles are spherical silicone resin fine particles.

5. An electrophotographic photosensitive member according to claim 1, wherein said degree of sphericity is 0.8 or higher.

6. An electrophotographic photosensitive member according to claim 1, wherein the photosensitive layer is composed of a lamination structure of a charge generation layer and a charge transport layer.

7. An electrophotographic photosensitive member according to claim 1, wherein the photosensitive layer is composed of a lamination structure of a charge generation layer and a charge transport layer, and the surface layer is the charge transport layer.

8. An electrophotographic photosensitive member according to claim 1, wherein the fine spherical resin powder has a particle size of 0.6 to 6 μm.

9. An electrophotographic photosensitive member according to claim 8, wherein the fine spherical resin particles have particles sizes of 1 to 4 μm.

10. An electrophotographic photosensitive member according to claim 1, wherein the fine spherical resin particles have specific gravities of 0.7 to 1.7.

11. An electrophotographic photosensitive member according to claim 10, wherein the fine spherical resin particles have specific gravities of 0.9 to 1.5.

12. An electrophotographic photosensitive member according to claim 7, wherein 10 to 20% by weight of the fine spherical resin powder is contained in the charge transport layer.

13. An electrophotographic photosensitive member according to claim 7, wherein the charge transport layer has a film thickness of 3 to 30 μm.

14. An electrophotographic photosensitive member according to claim 7, wherein the charge transport layer has a film thickness of 5 to 20 μm.

15. An electrophotographic photosensitive member according to claim 7, wherein the charge generation layer has a film thickness of 0.01 to 1 μm.

16. An electrophotographic photosensitive member according to claim 7, wherein the charge generation layer has a film thickness of 0.05 to 0.5 μm.

17. An electrophotographic photosensitive member according to claim 1, wherein the electroconductive support is composed of a lamination structure of a support and an electroconductive layer laid thereon.

18. An electrophotographic photosensitive member according to claim 1, wherein the electrophotographic photosensitive member is applied to an electrophotographic process using a layer beam as an image exposure light source.

19. An electrophotographic device which comprises an electrophotographic photosensitive member according to claim 1, an electrocharging means, a laser beam exposure means, and a developing means.

20. An electrophotographic device according to claim 19, wherein said fine spherical resin particles are of a setting type resin.

21. An electrophotographic device according to claim 20, wherein said setting type resin is a resin selected from silicone resins, melamine resins, urea resins, acrylic resins and styrene resins.

22. An electrophotographic device according to claim 19, wherein said fine spherical resin particles are spherical silicone resin fine particles.

23. An electrophotographic device according to claim 22, wherein said degree of sphericity is 0.8 or higher.

24. An electrophotographic device according to claim 19, wherein the photosensitive layer is composed of a lamination structure of a charge generation layer and a charge transport layer.

25. An electrophotographic device according to claim 19, wherein the photosensitive layer is composed of a lamination structure of a charge generation layer and a charge transport layer, and the surface layer is the charge transport layer.

26. An electrophotographic device according to claim 19, wherein the fine spherical resin powder has a particle size of 0.1 to 6 μm.

27. An electrophotographic device according to claim 26, wherein the fine spherical resin particles have particles sizes of 1 to 4 μm.

28. An electrophotographic device according to claim 19, wherein the fine spherical resin particles have specific gravities of 0.7 to 1.7.

29. An electrophotographic device according to claim 28, wherein the fine spherical resin particles have specific gravities of 0.9 to 1.5.

30. An electrophotographic device according to claim 25, wherein 10 to 20% by weight of the fine spherical resin powder is contained in the charge transport layer.

31. An electrophotographic device according to claim 25, wherein the charge transport layer has a film thickness of 3 to 30 μm.

32. An electrophotographic device according to claim 25, wherein the charge transport layer has a film thickness of 5 to 20 μm.

33. An electrophotographic device according to claim 25, wherein the charge generation layer has a film thickness of 0.01 to 1 μm.

34. An electrophotographic device according to claim 25, wherein the charge generation layer has a film thickness of 0.05 to 0.5 μm.

35. An electrophotographic device according to claim 19, wherein the electroconductive support is composed of a lamination structure of a support and an electroconductive layer laid thereon.

* * * * *

UNITED STATES PATENT AND TRADEMARK OFFICE

CERTIFICATE OF CORRECTION

PATENT NO. : 4,766,048

DATED : August 23, 1988

INVENTOR(S) : MASAFUMI HISAMURA

It is certified that error appears in the above-identified patent and that said Letters Patent is hereby corrected as shown below:

COLUMN 1

Line 12, "was" should read --uses--.
Line 32, "Moreover" should read --Moreover,--.

COLUMN 2

Line 34, "heliumneon" should read --helium neon--.

COLUMN 3

Line 6, "undergo" should be deleted.
Line 13, "layer beam 6," should read --laser beam 6,--.
Line 25, "layer n," should read --layer be n,--.
Line 47, "fringes" should read --fringe--.
Line 61, "a" should read --an--.

COLUMN 5

Line 63, "electroconductivity" should read --electroconductive--.

COLUMN 6

Line 27, "chlorideph-" should read --chloride--.
Line 28, "thalocyanine," should read --phthalocyanine,--.
Line 36, "compound" should read --compounds--.
Line 46, "acrylonitrilestyrene" should read --acrylonitrile-styrene--.
Line 61, "mechacrylate," should read --methacrylate,--.

UNITED STATES PATENT AND TRADEMARK OFFICE

CERTIFICATE OF CORRECTION

PATENT NO. : 4,766,048

DATED : August 23, 1988

INVENTOR(S) : MASAFUMI HISAMURA

It is certified that error appears in the above-identified patent and that said Letters Patent is hereby corrected as shown below:

COLUMN 7

Line 4, "dicarbozy-" should read --dicarboxy- --.
Line 42, "compativility" should read --compatibility--.
Line 58, "bring" should read --brings--.

COLUMN 8

Line 2, "water repellent" should read --water-repellent--.
Line 10, "water repellent" should read --water-repellent--
Line 20, "particle" should read --resin--.
Line 43, "On" should read --On--.

COLUMN 9

Line 28, "through" should read --thorough--.

COLUMN 11

Line 10, "polymethylmethacrylate" should read --polymethyl methacrylate--.
Line 39, "in 1" should read --in Example 1--.

COLUMN 14

Line 20, "celulose" should read --cellulose--.

COLUMN 15

Line 61, "ight" should read --weight--

UNITED STATES PATENT AND TRADEMARK OFFICE

CERTIFICATE OF CORRECTION

PATENT NO. : 4,766,048

DATED : August 23, 1988

INVENTOR(S) : MASAFUMI HISAMURA

It is certified that error appears in the above-identified patent and that said Letters Patent is hereby corrected as shown below:

COLUMN 18

Line 34, "tcne" should read --tone--.
Line 39, "eveluated" should read --evaluated--.
Line 40, "were" should read --are--.

COLUMN 20

Line 57, "not" should be deleted.

COLUMN 21

Line 62, "silimarly" should read --similarly--.

COLUMN 22

Line 7, "electrophotograhic" should read --electrophotographic--.

COLUMN 23

Line 15, "prepared. The" should read --prepared. ¶ The-
Line 56, "(polymathyl methacrylatedivinylbenzene" should read --(polymethyl methacrylate-divinylbenzene--

COLUMN 24

Line 10, "pulverizes" should read --pulverized--.
Line 68, "setting the" should read --setting type--.

UNITED STATES PATENT AND TRADEMARK OFFICE

CERTIFICATE OF CORRECTION

PATENT NO. : 4,766,048

DATED : August 23, 1988

INVENTOR(S) : MASAFUMI HISAMURA

It is certified that error appears in the above-identified patent and that said Letters Patent is hereby corrected as shown below:

COLUMN 25

Line 23, "particles" (second occurrence) should read --particle--.

Line 54, "layer beam" should read --laser beam--.

COLUMN 26

Line 30, "particles" should read --particle--.

Signed and Sealed this

Twenty-eighth Day of February, 1989

*Attest:*

DONALD J. QUIGG

*Attesting Officer*

*Commissioner of Patents and Trademarks*